US008951051B2

(12) United States Patent
Natter et al.

(10) Patent No.: US 8,951,051 B2
(45) Date of Patent: Feb. 10, 2015

(54) CONNECTOR HAVING OPTIMIZED TIP

(75) Inventors: Brantley Natter, Brighton, MI (US); Michael Hardy, Ypsilanti, MI (US); Slobodan Pavlovic, Novi, MI (US); Michael Glick, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 192 days.

(21) Appl. No.: 13/269,684

(22) Filed: Oct. 10, 2011

(65) Prior Publication Data

US 2013/0090012 A1 Apr. 11, 2013

(51) Int. Cl.
*H01R 13/44* (2006.01)

(52) U.S. Cl.
USPC ..... 439/149; 439/135

(58) Field of Classification Search
USPC ..... 439/146, 135–138, 149
See application file for complete search history.

(56) References Cited

U.S. PATENT DOCUMENTS

| | | | | |
|---|---|---|---|---|
| 2,537,370 | A | 1/1951 | Parnes | |
| 2,774,951 | A | 12/1956 | Kinkaid et al. | |
| 2,921,287 | A | 1/1960 | Matthysse et al. | |
| 3,123,424 | A | 3/1964 | Williams | |
| 3,258,731 | A | 6/1966 | Still et al. | |
| 3,550,069 | A | 12/1970 | Teagno | |
| 3,638,166 | A | 1/1972 | Steipe | |
| 3,735,332 | A * | 5/1973 | Tirrell | 439/744 |
| 3,792,420 | A | 2/1974 | Konnemann et al. | |
| 3,804,996 | A * | 4/1974 | Monteith | 191/1 R |
| 3,957,528 | A | 5/1976 | Ott et al. | |
| 4,040,713 | A | 8/1977 | Konnemann | |
| 4,082,396 | A * | 4/1978 | Coley et al. | 439/149 |
| 4,385,794 | A | 5/1983 | Lucius | |
| 4,430,524 | A * | 2/1984 | Santucci | 174/138 F |
| 4,531,800 | A * | 7/1985 | Avener | 439/373 |
| 4,540,235 | A | 9/1985 | Lolic | |
| 4,553,808 | A | 11/1985 | Weidler et al. | |
| 4,570,147 | A | 2/1986 | Ebi | |
| 4,583,812 | A | 4/1986 | Gross, Jr. et al. | |
| 4,646,052 | A | 2/1987 | Matsunaga et al. | |
| 4,672,352 | A | 6/1987 | Takano | |
| 4,751,490 | A | 6/1988 | Hatagishi | |
| 4,842,534 | A | 6/1989 | Mobley et al. | |
| 4,869,972 | A | 9/1989 | Hatagishi | |
| 4,871,990 | A | 10/1989 | Ikeda et al. | |
| 4,884,050 | A * | 11/1989 | Kozel | 337/264 |
| 4,941,851 | A | 7/1990 | Hsueh | |

(Continued)

FOREIGN PATENT DOCUMENTS

| | | | |
|---|---|---|---|
| CN | 201805040 | U | 4/2011 |
| DE | 10149201 | C1 | 6/2003 |

(Continued)

OTHER PUBLICATIONS

German Patent & Trademark Office, Office Action for the corresponding German Patent Application No. 10 2012 218 469.4 mailed Jul. 2, 2014.

(Continued)

*Primary Examiner* — Truc Nguyen
(74) *Attorney, Agent, or Firm* — Brooks Kushman P.C.

(57) ABSTRACT

A connector having an optimized tip is disclosed. The tip may be optimized to facilitate insulating the connector and/or providing a low friction surface to facilitate insertion. The tip may be optimized with a non-conducting and/or low friction end cap configured to be positioned over the tip.

22 Claims, 4 Drawing Sheets

(56) References Cited

U.S. PATENT DOCUMENTS

| | | | | |
|---|---|---|---|---|
| 4,958,426 | A | 9/1990 | Endo et al. | |
| 5,006,076 | A * | 4/1991 | Robinson et al. | 439/146 |
| 5,007,865 | A | 4/1991 | Jakobeit | |
| 5,022,868 | A | 6/1991 | Legrady | |
| 5,035,661 | A | 7/1991 | Steinhardt et al. | |
| 5,064,379 | A | 11/1991 | Ryll et al. | |
| 5,088,940 | A | 2/1992 | Saito | |
| 5,147,219 | A | 9/1992 | Gilberts et al. | |
| 5,147,230 | A | 9/1992 | Plyler et al. | |
| 5,226,842 | A | 7/1993 | Endo et al. | |
| 5,295,873 | A | 3/1994 | Walbrecht | |
| 5,334,058 | A | 8/1994 | Hotea | |
| 5,338,229 | A | 8/1994 | Egenolf | |
| 5,342,355 | A * | 8/1994 | Long | 606/27 |
| 5,344,330 | A * | 9/1994 | Hoffman | 439/138 |
| 5,350,321 | A | 9/1994 | Takenouchi | |
| 5,362,262 | A | 11/1994 | Hotea | |
| 5,416,461 | A | 5/1995 | Totsuka et al. | |
| 5,427,552 | A | 6/1995 | Zielinski et al. | |
| 5,431,758 | A | 7/1995 | Delalle | |
| 5,474,475 | A | 12/1995 | Yamaguchi | |
| 5,488,346 | A | 1/1996 | Kondo et al. | |
| 5,571,024 | A * | 11/1996 | Ranoia | 439/146 |
| 5,573,412 | A | 11/1996 | Anthony | |
| 5,573,434 | A | 11/1996 | Ittah et al. | |
| 5,581,225 | A | 12/1996 | Oh et al. | |
| 5,658,174 | A | 8/1997 | Benes et al. | |
| 5,662,487 | A | 9/1997 | Okamura et al. | |
| 5,679,034 | A | 10/1997 | Hanazaki et al. | |
| 5,716,245 | A | 2/1998 | Kameyama et al. | |
| 5,739,741 | A | 4/1998 | Hanazaki et al. | |
| 5,745,024 | A | 4/1998 | Ohta et al. | |
| 5,795,193 | A | 8/1998 | Yang | |
| 5,807,133 | A | 9/1998 | Arnett | |
| 5,886,611 | A | 3/1999 | Schaller et al. | |
| 6,159,036 | A | 12/2000 | Daoud | |
| 6,178,106 | B1 | 1/2001 | Umemoto et al. | |
| 6,315,599 | B1 | 11/2001 | Daoud | |
| D460,420 | S * | 7/2002 | Whipple | D13/154 |
| 6,431,880 | B1 | 8/2002 | Davis et al. | |
| 6,506,060 | B2 | 1/2003 | Sumida et al. | |
| 6,537,091 | B2 | 3/2003 | Hirai et al. | |
| 6,558,198 | B2 | 5/2003 | Kobayashi et al. | |
| 6,572,420 | B2 | 6/2003 | Lawrence | |
| 6,589,084 | B1 | 7/2003 | Frank | |
| 6,676,422 | B1 | 1/2004 | Baker et al. | |
| 6,759,938 | B2 | 7/2004 | Matsumura et al. | |
| 6,824,430 | B2 | 11/2004 | Matsumura et al. | |
| 6,945,826 | B2 * | 9/2005 | Wise | 439/693 |
| 7,071,808 | B2 | 7/2006 | Nakamura | |
| 7,094,114 | B2 | 8/2006 | Kurimoto | |
| 7,592,892 | B2 | 9/2009 | Ito et al. | |
| 7,594,832 | B2 | 9/2009 | Oka et al. | |
| 7,595,715 | B2 | 9/2009 | Pavlovic et al. | |
| 7,612,647 | B2 | 11/2009 | Onoda et al. | |
| 7,780,489 | B2 | 8/2010 | Stuklek | |
| 7,883,261 | B2 | 2/2011 | Yu | |
| 7,892,050 | B2 | 2/2011 | Pavlovic et al. | |
| 8,142,211 | B2 * | 3/2012 | Bernstein et al. | 439/135 |
| 2001/0044239 | A1 | 11/2001 | Gugliotti et al. | |
| 2004/0124963 | A1 | 7/2004 | Nakamura | |
| 2006/0148287 | A1 | 7/2006 | Zahnen et al. | |
| 2006/0205267 | A1 | 9/2006 | Darr et al. | |
| 2007/0202735 | A1 | 8/2007 | Hanks | |
| 2008/0224814 | A1 | 9/2008 | Pavlovic et al. | |
| 2010/0267292 | A1 | 10/2010 | Pueschner et al. | |
| 2012/0164893 | A1 * | 6/2012 | Mitsuzuka et al. | 439/692 |

FOREIGN PATENT DOCUMENTS

| | | | |
|---|---|---|---|
| DE | 202011005271 | U1 | 7/2011 |
| EP | 0823753 | A1 | 2/1998 |
| GB | 326133 | A | 2/1930 |
| JP | 09147731 | A | 6/1997 |
| JP | 2000133114 | A | 5/2000 |
| JP | 2001266986 | A | 9/2001 |
| WO | 2011030712 | A1 | 3/2011 |

OTHER PUBLICATIONS

Chinese Patent Application No. 201210376993.3, First Office Action dated Aug. 5, 2014.

* cited by examiner

CONNECTOR HAVING OPTIMIZED TIP

TECHNICAL FIELD

The present invention relates connectors, such as but not limited to male and female connectors configured to facilitate high voltage interconnect between a vehicle-based high voltage battery charging system and a plug-in cordset.

BACKGROUND

Electrical connectors are used in a number of environments to facilitate electrically connecting to one or more components. Electrical connectors may be used within a receptacle to facilitate electrical interconnect with a device designed to be received within the receptacle. In the event the connector is exposed within the receptacle and a person were to inadvertently touch the connector while the connector is being powered, the person could establish an undesirable electrical connection with the connector. Accordingly, the present invention contemplates configuring the connector to limit the likelihood that a person or device could inadvertently touch the connector in a manner that would likely establish an electrical connection.

SUMMARY

One non-limiting aspect of the present invention contemplates a touch proof blade connector having a blade-shaped conducting body portion narrowing to a tip at one end; and a non-conducting end cap secured to the tip.

One non-limiting aspect of the present invention contemplates a touch proof blade connector further comprising a non-conducting blade shroud surrounding an entire outer perimeter of the blade-shaped conducting body portion.

One non-limiting aspect of the present invention contemplates a touch proof blade connector wherein the non-conducting blade shroud includes at least one sidewall extending beyond an end of the non-conducting end cap.

One non-limiting aspect of the present invention contemplates a touch proof blade connector wherein the non-conducting blade shroud is secured to the blade-shaped conducting body portion.

One non-limiting aspect of the present invention contemplates a touch proof blade connector wherein the non-conducting blade shroud is included as part of a connector assembly included within a vehicle to facilitate electrical interconnect with at least one female terminal included on a plug-in cordset.

One non-limiting aspect of the present invention contemplates a touch proof blade connector wherein the tip is formed by skiving the blade-shaped conducting body portion.

One non-limiting aspect of the present invention contemplates a touch proof blade connector wherein a top and a bottom of the tip angle downwardly to a point and a left side and a right side between the top and the bottom each include at least one ridge.

One non-limiting aspect of the present invention contemplates a touch proof blade connector wherein the non-conducting end cap includes an opening opposite the point, wherein a left side and a right side of the opening at least partially deforms proximate the at least one ridge when positioned over the tip.

One non-limiting aspect of the present invention contemplates a touch proof blade connector wherein the end cap is overmolded to the tip.

One non-limiting aspect of the present invention contemplates a touch proof blade connector wherein the non-conducting end cap entirely surrounds the tip.

One non-limiting aspect of the present invention contemplates a touch proof blade connector wherein the non-conducting end cap cover substantially all of a top and a bottom of the tip but not a left and a right side between the top and the bottom.

One non-limiting aspect of the present invention contemplates a touch proof blade connector wherein the non-conducting end cap includes a tang configured to lodge within a recess of the tip to prevent removal of the end cap from the tip.

One non-limiting aspect of the present invention contemplates a touch proof blade connector further comprising a metal inset positioned over substantially an entire top and bottom of the non-conducting end cap.

One non-limiting aspect of the present invention contemplates a touch proof blade connector wherein the metal inset has a lower coefficient of friction than the non-conducting end cap.

One non-limiting aspect of the present invention contemplates a method of manufacturing a blade connector comprising: stamping a conducting body portion; skiving one end of the stamped conducting body portion into a tip; and attaching a non-conducting end cap to the tip.

One non-limiting aspect of the present invention contemplates a method of manufacturing a blade connector further comprising press fitting an opening within the non-conducting end cap over the tip.

One non-limiting aspect of the present invention contemplates a method of manufacturing a blade connector further comprising securing a low friction inset to the non-conducting end cap by positioning a tang included within the inset relative to a recessed included within the non-conducting end cap, the low friction inset having a lower coefficient of friction than the non-conducting end cap.

One non-limiting aspect of the present invention contemplates a method of manufacturing a blade connector further comprising overmolding the non-conducting end cap to the tip.

One non-limiting aspect of the present invention contemplates a connector comprising: a female-shaped conducting body portion having at least one set of opposed fingers, wherein at least a portion of the opposed fingers are coated with a low friction substance, the low friction substance having a lower coefficient of friction than the female-shaped conducting body portion; and a blade-shaped conducting body portion shaped to engage the at least one set of opposed fingers, the blade-shaped conducting body portion having a tip at one end and a non-conducting end cap secured to the tip.

One non-limiting aspect of the present invention contemplates a connector wherein the non-conducting end cap includes a low friction inset to engage the low friction substance, the low friction inset having a lower coefficient of friction than the non-conducting end cap.

DETAILED DESCRIPTION

As required, detailed embodiments of the present invention are disclosed herein; however, it is to be understood the disclosed embodiments are merely exemplary of the end cap invention which may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
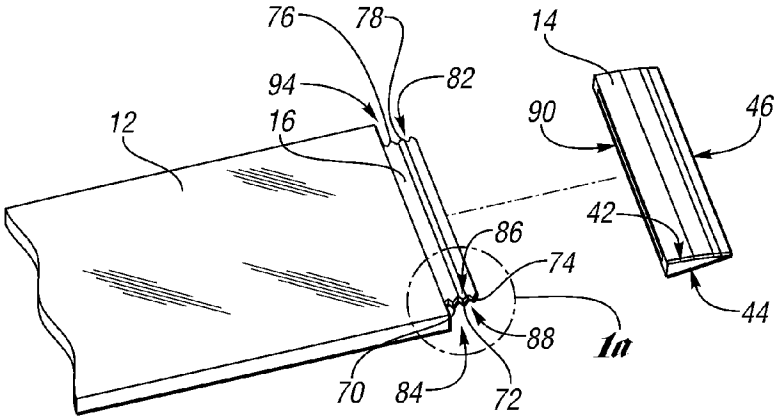
FIGS. 1-2 illustrate a blade connector as contemplated by one non-limiting aspect of the present invention.
Figure 1A:
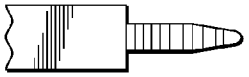
Figure 2:
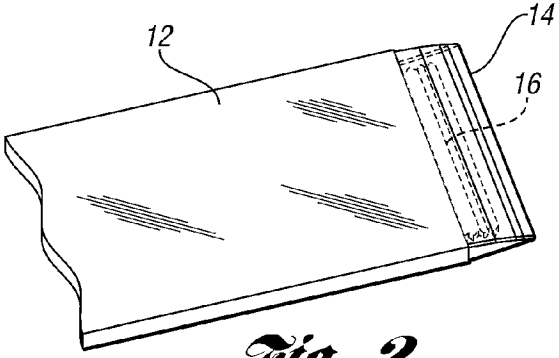

FIGS. 1-2 illustrate a blade connector 10 as contemplated by one non-limiting aspect of the present invention. The blade connector 10 is shown to be comprised of a body portion 12 and an end cap 14 secured over a tip 16. The end cap 14 may be comprised of a conducting or a non-conducting material, as described below in more detail. The body portion 12 is shown to be a generally planar and formed from a stamp piece of material. This configuration of the body portion 12 may be beneficial in supporting high current and high voltage conductivity. Of course, the present invention is not necessary limited to this configuration and fully contemplates the body 12, the tip 16, and/or the end cap 14 having any other desirable configuration and shape. This exemplary illustration of the blade connector 10 is provided to demonstrate one non-limiting aspect of the present invention where the blade connector 10 may be configured to facilitate receipt within a female connector.

Figure 3:
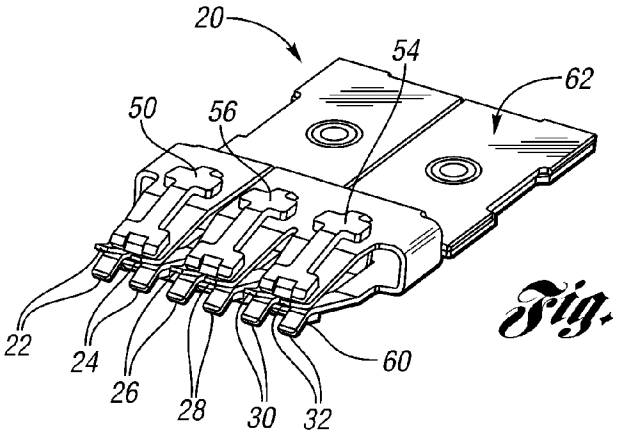
FIG. 3 illustrates the female connector contemplated by one non-limiting aspect of the present invention configured to facilitate receipt of the blade connector.

FIG. 3 illustrates a female connector 20 contemplated by one non-limiting aspect of the present invention to facilitate receipt of the blade connector 10, such as but not limited to the connector described in U.S. patent application Ser. No. 12/963,968, now U.S. Pat. No. 8,366,497 the disclosure of which is hereby incorporated by reference in its entirety. Together, the blade connector 10 and female connector 20 may comprise a connector system where the blade connector 10 may be characterized as male connector. The blade connector 10 may be sized and shaped in a manner that engages opposed fingers 22, 24, 26, 28, 30, 32 of the female connector 20 such that the opposed fingers 22, 24, 26, 28, 30, 32 are spread apart as they travel along an inclined top 42 and bottom 44 of the end cap 14 beginning from a point 46 at which the top 42 and bottom 44 slope inwardly to meet. The female connector 20 may include a plurality of spring clips 50, 52, 54 configured to apply normal force to the opposed fingers 22, 24, 26, 28, 30, 32 in order to maximize electrical conductivity with the blade connector 10.

The inclination of the top 42 and bottom 44 of the end cap 14 may be beneficial in ameliorating an insertion force required to insert the blade connector 10 between the opposed fingers 22, 24, 26, 28, 30, 32. Optionally, one or more of the opposed fingers may be coated or plated with a low friction substance 60 to further ameliorate the insertion force required for the blade connector 10 to be received by the female connector 20. The low friction substance 60 may have a lower coefficient of friction than the material comprising the opposed fingers 22, 24, 26, 28, 30, 32 and/or a body portion 62, e.g., the low friction substance 60 may be a Teflon, ceramic, or other material having a lower coefficient of friction than a copper or copper alloy comprising the opposed fingers 22, 24, 26, 28, 30, 32 and/or the body portion 62. The low friction substance 60 may be comprised of a conducting or non-conducting material. In the event the low friction substance 60 is non-conducting, the coating may be limited to portions of the opposed fingers 22, 24, 26, 28, 30, 32 where electrical conductivity is not required, i.e., to portions forward of the meeting area with the blade connector 10 when the blade connector is properly positioned within the female connector 20.

Figure 4:
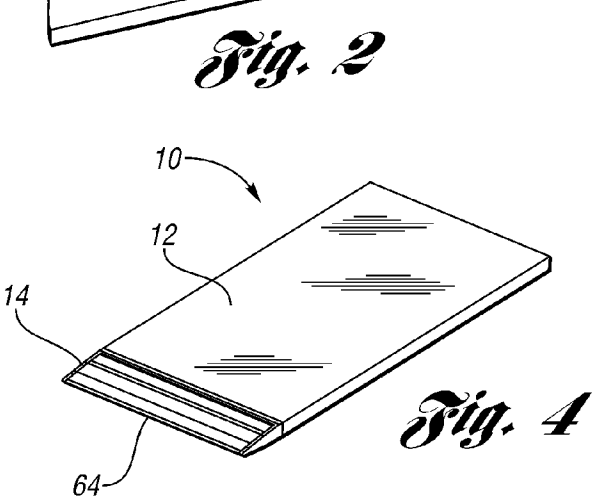
FIG. 4 illustrates the blade connector where the end cap is coated with a low friction substance, which may be similar to the substance used to coat the opposed fingers.

FIG. 4 illustrates the blade connector 10 where the end cap is coated with a low friction substance 64, which may be similar to the substance 60 used to coat the opposed fingers 22, 24, 26, 28, 30, 32. The additional use of the low friction substance 64 may be beneficial in yet further controlling the insertion force. As shown, the low friction substance 64 is coated over the end cap 14, however, the present invention fully contemplates instead forming the tip 16 of the body portion 12 into the configuration of the end cap 14 so that the use of the end cap 14 can be eliminated. In such a configuration, the low friction substance 64 material may be applied directly to the tip 16 instead of the end cap 14. The use of the end cap 14 with the friction substance 64 may be preferred in that it may be more cost-effective to mass-produce the end cap 14 with the low friction substance 64 rather than coating the low friction substance 64 on the body portion 12. Optionally, an insulating coating (not shown) may be applied before applying the low friction substance 64 if electrical insulation is desired.

Returning to FIGS. 1-2, the attachment of the end cap 14 to the tip 16 may be facilitated with a plurality of ridges 70, 72, 74, 76, 78, 80 included on a left side 82 and right side 84 of the tip 16 extending between a top 86 and a bottom 88. The ridges 70, 72, 74, 76, 78, 80 may be configured to engage sides of an opening 90 included within the end cap 14 when the end cap 14 is press-fit or otherwise inserted over the tip 16. The engagement may be sufficient to deform the sides of the opening 90 or otherwise provide a sufficient engagement such that the end cap 14 is securely retained to the tip 16. The body portion 12 may be integral with the tip 16 in that the tip 16 may be formed at the same time as the body portion 12, such as in a stamping operation. Optionally, the tip 16 may be formed after the forming of the body portion 12, such as in a skiving operation where the tip 16 is skived from the body portion 12. The skiving operation may be more beneficial than the stamping operation in that it may be used to shape the tip 16 from the body portion 12 by removing material versus the stamping operation where the material is compressed. The material skiving may be preferred over the stamping since the stamping compression may create a bulge, ripple or other protuberance along a boundary 94 between the tip 16 and the body portion 12. This obstruction may prevent a proper seating of the end cap 14 and/or hinder a seamless transition between the exterior surfaces of the end cap 14 and the body 12 at the boundary 94. This obstruction may also cause an offset between the blade 10 and the female connector 20 or other mating connector in a manner that negatively influences conductivity the engagement of the blade connector 10 into the female connector 20.

The end cap 14 may be comprised of a conducting or non-conducting material. The use of a conducting material may be beneficial in situations where it may be desirable to cover the tip 16 with a conducting material other than the material comprising the body portion 12, such as a connector system housing containing multiple terminal pairs and an earthing ground. It would be beneficial to have the earthing mate as soon as possible so that there is no potential shock hazard with having the conductive tip exposed. The use of a non-conducting material may be beneficial in environments where it may be desirable to prevent inadvertent touching of the blade connector 10 by insulating the tip 16, such as to prevent inadvertent touching when the blade connector 10 is included as part of a connector assembly included within a vehicle to facilitate electrical interconnect with at least one female terminal included on a plug-in cordset. Regardless of whether the end cap 14 is conducting or non-conducting, the use of the end cap 14 may also be beneficial when it is that desirable to attach differently sized hats to a commonly sized body portion/tip 16 so that end caps 14 can be selectively attached depending on the particular application of the blade connector 10.

Figure 5:
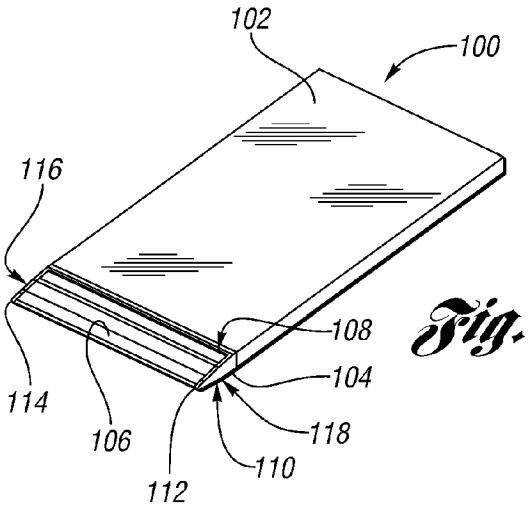
FIG. 5 illustrates a blade connector as contemplated by one un-limiting aspect of the present invention.
Figure 6:
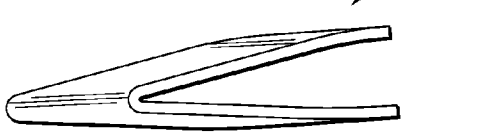
FIG. 6 illustrates a perspective view of the inset as contemplated by one un-limiting aspect of the present invention FIG. 7 illustrate the inset having a tang as contemplated by one non-limiting aspect of the present invention.

FIG. 5 illustrates a blade connector 100 as contemplated by one non-limiting aspect of the present invention. The blade connector 100 may include a body portion 102 and a tip (not shown) similar to that shown above in FIG. 1. The blade connector 100 also includes a non-conducting end cap 104 with a low friction inset 106. The low friction inset 106 may be comprised of a material having a lower coefficient of friction than the end cap 104 so as to control and facilitate management of the insertion force. The inset 106 is shown to be comprised of a metal, however, the inset 106 may be comprised of any suitable conducting or non-conducting material. FIG. 6 illustrates a perspective view of the inset 106 as contemplated by one un-limiting aspect of the present invention. As best shown in FIG. 6, the inset 106 may cover substantially all of the entire top 108 and bottom 110 of the end cap 104 except for portions 112, 114 proximate the left side and the right side 116, 118.

Figure 8:
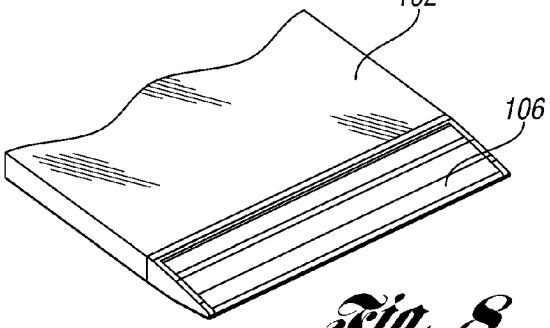
FIG. 8 illustrates the inset being attach directly to the body portion in accordance with one un-limiting aspect of the present invention.
Figure 7:
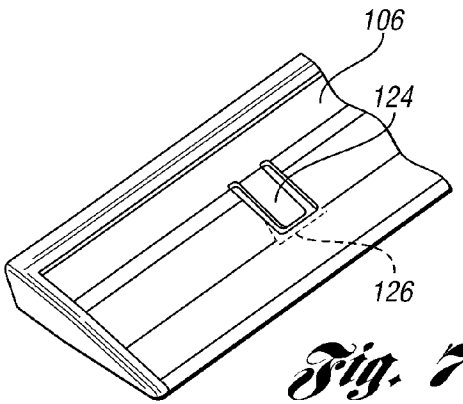

FIG. 7 illustrate the inset 106 having a tang 124 as contemplated by one non-limiting aspect of the present invention. The tang 124 may be configured to lodge within a recess 126 of the end cap 104. The tang 124 may be bent slightly inwardly to facilitate its lodging within the recess 126. The use of the tang 124, however, is but one means for facilitating attachment of the inset 106 to the end cap 104. The inset 106 may be similarly secured to the end cap 104 with an adhesive and/or it may be molded as part of the end cap 104. FIG. 8 illustrates the inset 106 being attached directly to the body portion 102 in accordance with one non-limiting aspect of the present invention. This configuration may be used in the event that the end cap 104 is eliminated in favor of instead forming an end of the body portion 102 into the illustrated configuration, such as in the event electrical isolation is not desired between the inset 106 and the body portion 102 and/or in the event the inset is non-conducting.

Figure 9:
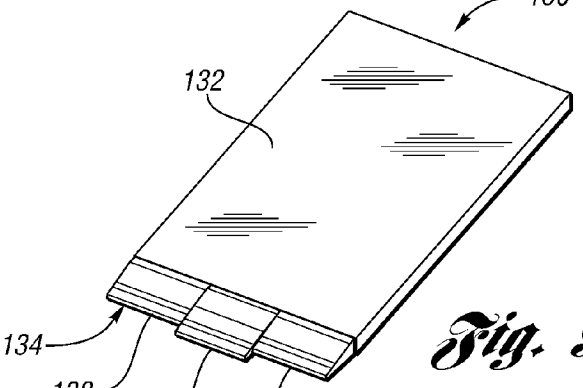
FIG. 9 illustrates a blade connector as contemplated by one non-limiting aspect of the present invention.

FIG. 9 illustrates a blade connector 130 as contemplated by one non-limiting aspect of the present invention. The blade connector 130 may include a body portion 132 and a tip (not shown) similar to that shown above in FIG. 1. The blade connector 130 may include a staggered end cap 134 attached to the tip. The staggered end cap 134 is shown to be comprised of a non-conducting material, however, the present invention fully contemplates the staggered end cap being comprised of a metallic material. The staggered end cap 134 is shown to include a first portion 138, a second portion 140, and a third portion 142 where the second portion 140 is staggered relative to the first and third portions 138, 142. The staggering of the portions 138, 140, 142 may be beneficial in controlling and/or managing the insertion force by causing less than an entire length of the end cap 134 to engage the mating connector at the same time.

Figure 10:
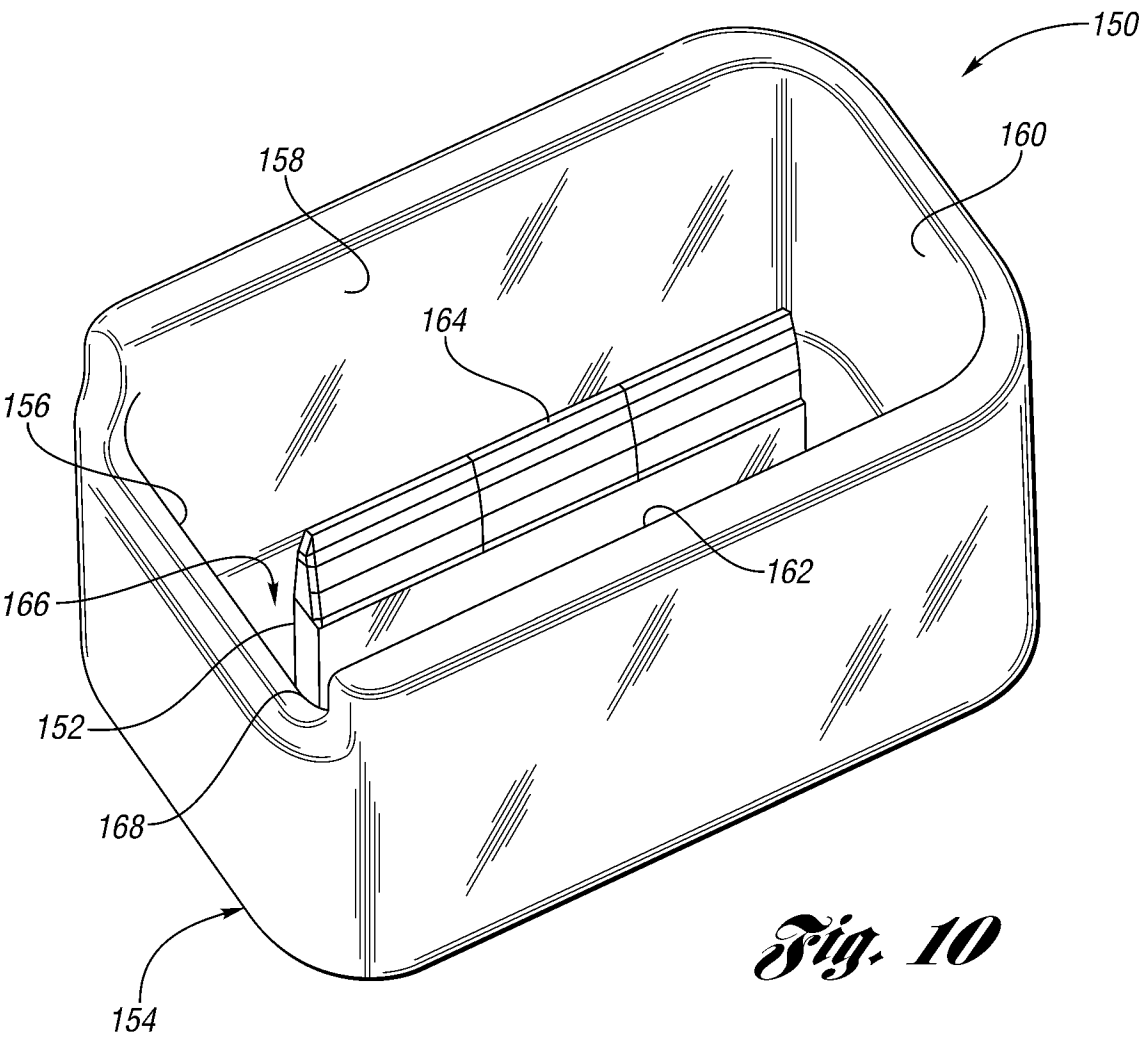
FIG. 10 illustrates a shrouded connector assembly as contemplated by one non-limiting aspect of the present invention.

FIG. 10 illustrates a shrouded connector assembly 150 as contemplated by one non-limiting aspect of the present invention. The shrouded connector assembly 150 may be comprised of one of a blade connector 152, such as but not limited to one of the blade connectors described above, and a shroud 154. The shroud 154 may be comprised of a conducting or non-conducting material in order to guard against touching of the blade connector 152. The shroud 154 may be included as part of a receptacle assembly or other connection assembly (not shown), such as but not limited to those used to facilitate plug-and charging of a high-voltage battery included within an electric or partially electric vehicle. FIG. 10 illustrates a single assembly where a single shroud 154 and a single blade connector 152 are shown, however, the present invention fully contemplates the use of multiple shrouds with multiple blade connectors and/or a female connectors.

The shrouded connector assembly 150 is shown with the blade connector 152 entirely surrounded by the shroud 154. The shroud 154 is shown to include a plurality of sidewalls 156, 158, 160, 162 having a height sufficient to extend beyond a point 164 of the blade connector 152. One of the sidewalls 156 is shown to be slightly lower than the other sidewalls 158, 160, 162, such as to prevent contacting the conductive portion of the tip. The shroud 154 may be attached directly to the blade terminal 152, such as through an overmolding process, and/or it may be otherwise securely affixed to the blade connector 152, such as with the use of a clip or other connection mechanism (not shown). The shroud 154 is shown to include a base 166 having an opening 168 through which the blade connector 152 extends. The opening 168 may be size to facilitate a press-fit connection between the blade 152 and the shroud 154. The depth of the base 166 from a top of the shroud 154 may be adjusted depending on a nesting depth of the blade connector 152 within the mating connector (not shown).

Figure 11A:
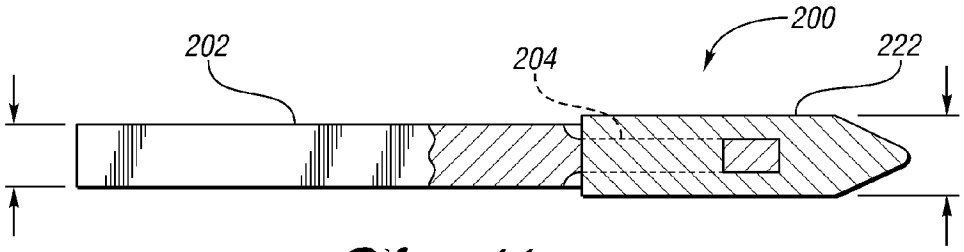
FIGS. 11*a*-11*c* illustrate a blade connector as contemplated by one non-limiting aspect of the present invention.
Figure 11B:
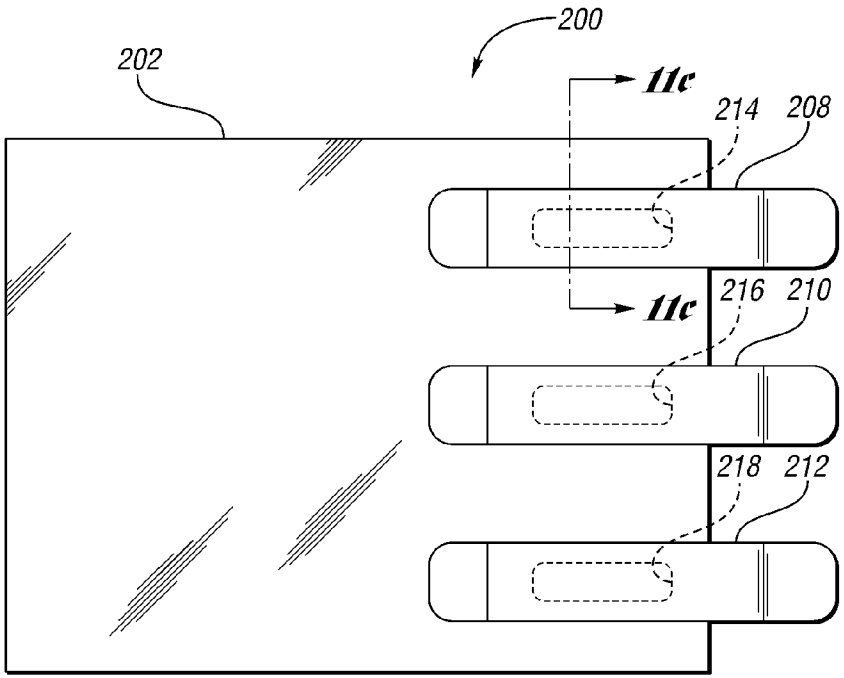
Figure 11C:
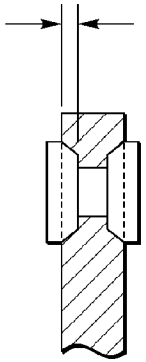

FIG. 11*a*-11*c* illustrate a blade connector 200 as contemplated by one non-limiting aspect of the present invention. The blade connector 200 may include a body portion 202 and a tip 204. The tip 204 may be different from the above-describe tips in that it may include a plurality of openings 214, 216, 218. The plurality of openings 214, 216, 218 having a plurality of may extend completely through the tip 204 to facilitate overmolding of an end cap 222. The material comprising the end cap 222 may flow through the openings 214, 216, 218 during the molding process to facilitate securely attaching the end cap 222 to the body portion 202. While the blade connectors described above contemplated overmolding the end cap to the tip without necessarily requiring the opening and/or other repayment features within the tip, it is believed that the use of openings 214, 216, 218 may facilitate the molding process and a strong securement of the end cap.

While exemplary embodiments are described above, it is not intended end cap these embodiments describe all possible forms of the invention. Rather, the words used in the specification are words of description rather than limitation, and it is understood end cap various changes may be made without departing from the spirit and scope of the invention. Additionally, the features of various implementing embodiments may be combined to form further embodiments of the invention.

What is claimed is:

1. A touch proof blade connector comprising:

a blade-shaped conducting body portion narrowing to a tip at one end;

a non-conducting end cap secured to the tip; and a metal inset positioned over substantially an entire top and bottom of the non-conducting end cap.

2. The touch proof blade connector of claim 1 further comprising a non-conducting blade shroud surrounding substantially an entire outer perimeter of the blade-shaped conducting body portion.

3. The touch proof blade connector of claim 2 wherein the non-conducting blade shroud includes at least one sidewall extending beyond an end of the non-conducting end cap.

4. The touch proof blade connector of claim 2 wherein the non-conducting blade shroud is secured to the blade-shaped conducting body portion.

5. The touch proof blade connector of claim 4 wherein the non-conducting blade shroud is part of a connector assembly included within a vehicle to facilitate electrical interconnect with at least one female terminal included on a plug-in cordset.

6. The touch proof blade connector of claim 1 wherein the tip is formed by skiving the blade-shaped conducting body portion.

7. The touch proof blade connector of claim 1 wherein a top and a bottom of the tip angle downwardly to a point and a left side and a right side between the top and the bottom each include at least one ridge.

8. The touch proof blade connector of claim 7 wherein the non-conducting end cap includes an opening opposite the point, wherein a left side and a right side of the opening at least partially deforms proximate the at least one ridge when positioned over the tip.

9. The touch proof blade connector of claim 1 wherein the end cap is overmolded to the tip.

10. The touch proof blade connector of claim 1 wherein the non-conducting end cap entirely surrounds the tip.

11. The touch proof blade connector of claim 1 wherein the non-conducting end cap covers substantially all of a top and a bottom of the tip but not a left and a right side between the top and the bottom.

12. The touch proof blade connector of claim 1 wherein the non-conducting end cap includes a tang configured to lodge within a recess of the tip to prevent removal of the end cap from the tip.

13. The touch proof blade connector of claim 1 wherein the metal inset has a lower coefficient of friction than the non-conducting end cap.

14. A method of manufacturing a blade connector comprising:

stamping a conducting body portion;

skiving one end of the stamped conducting body portion into a tip;

attaching a non-conducting end cap to the tip; and positioning a metal inset over substantially an entire top and bottom of the non-conducting end cap.

15. The method of claim 14 further comprising press fitting an opening within the non-conducting end cap over the tip.

16. The method of claim 14 further comprising securing a low friction inset to the non-conducting end cap by positioning a tang included within the inset relative to a recess included within the non-conducting end cap, the low friction inset having a lower coefficient of friction than the non-conducting end cap.

17. The method of claim 14 further comprising overmolding the non-conducting end cap to the tip.

18. A connector comprising:

a female-shaped conducting body portion having at least one set of opposed fingers, wherein at least a portion of the opposed fingers are coated with a low friction substance, the low friction substance having a lower coefficient of friction than the female-shaped conducting body portion; and a blade-shaped conducting body portion shaped to engage at least one set of opposed fingers, the blade-shaped conducting body portion having a tip at one end, a non-conducting end cap secured to the tip, and a metal inset positioned over substantially an entire top and bottom of the non-conducting end cap.

19. The connector of claim 18 wherein the non-conducting end cap includes a low friction inset to engage the low friction substance, the low friction inset having a lower coefficient of friction than the non-conducting end cap.

20. A touch proof blade connector comprising:

a blade-shaped conducting body portion narrowing to a tip at one end; and a non-conducting end cap secured to the tip;

wherein a top and a bottom of the tip angle downwardly to a point and a left side and a right side between the top and the bottom each include at least one ridge.

21. A method of manufacturing a blade connector comprising:

stamping a conducting body portion;

skiving one end of the stamped conducting body portion into a tip, wherein a top and a bottom of the tip angle downwardly to a point and a left side and a right side between the top and the bottom each include at least one ridge; and attaching a non-conducting end cap to the tip.

22. A connector comprising:

a female-shaped conducting body portion having at least one set of opposed fingers, wherein at least a portion of the opposed fingers are coated with a low friction substance, the low friction substance having a lower coefficient of friction than the female-shaped conducting body portion; and a blade-shaped conducting body portion shaped to engage at least one set of opposed fingers, the blade-shaped conducting body portion having a tip at one end and a non-conducting end cap secured to the tip, wherein a top and a bottom of the tip angle downwardly to a point and a left side and a right side between the top and the bottom each include at least one ridge.

* * * * *